United States Patent [19]

Garner

[11] 4,269,023

[45] May 26, 1981

[54] APPARATUS FOR USE IN FLUIDIZED POWDER FILLING OF MULTIPLE CORE UNIT CABLES

[75] Inventor: John N. Garner, Pointe Claire, Canada

[73] Assignee: Northern Telecom Limited, Montreal, Canada

[21] Appl. No.: 56,282

[22] Filed: Jul. 9, 1979

Related U.S. Application Data

[63] Continuation-in-part of Ser. No. 930,236, Aug. 2, 1978, Pat. No. 4,205,515.

[51] Int. Cl.[3] ..... H01B 13/00

[52] U.S. Cl. ..... 57/1 UN; 57/101; 57/314; 118/44; 118/DIG. 5; 118/DIG. 19; 156/48; 427/185

[58] Field of Search ..... 156/48, 50; 57/1 UN, 57/101, 314, 2.3, 2.5, 3.5, 8; 118/44, DIG. 5, DIG. 19; 427/185; 308/9, DIG. 1

[56] References Cited

U.S. PATENT DOCUMENTS

| | | | |
|---|---|---|---|
| 3,103,364 | 9/1963 | Mocks et al. | 308/DIG. 1 |
| 3,152,845 | 10/1964 | Entaud et al. | 308/DIG. 1 |
| 3,324,643 | 6/1967 | Kluttz | 57/101 |
| 3,696,599 | 10/1972 | Palmer et al. | 57/1 UN |
| 3,707,836 | 1/1973 | Lovett, Jr. | 57/1 UN |
| 3,744,858 | 7/1973 | Weichsel | 308/DIG. 1 |
| 3,889,455 | 6/1975 | Portinari et al. | 156/48 |
| 3,972,304 | 8/1976 | Boucher | 118/44 |
| 4,100,002 | 7/1978 | Woytink et al. | 156/48 |
| 4,105,485 | 8/1978 | Portinari et al. | 156/48 |

*Primary Examiner*—Michael W. Ball
*Attorney, Agent, or Firm*—R. J. Austin

[57] ABSTRACT

For powder filling of cables, in a fluidized powder bed, it has been proposed to pass the cable core through the bed in a substantially closed condition. There is a limit to the number of conductors a core can have for effective filling. In the present invention the cable core is opened up into a number of core units by passing through an opening member. The opening member is freely ridable on the cable core and has a hole for each unit. The opener is held against a support member and an air bearing formed between the two members. Air is also usually fed to the holes in the opener member through which the core units pass to prevent flow of powder out from the bed. The opening member can be positioned in the fluidized bed or outside immediately prior to passage of the cable core through the bed. The units are each in a substantially closed condition in the bed and the units close to a single core also in the bed.

10 Claims, 10 Drawing Figures

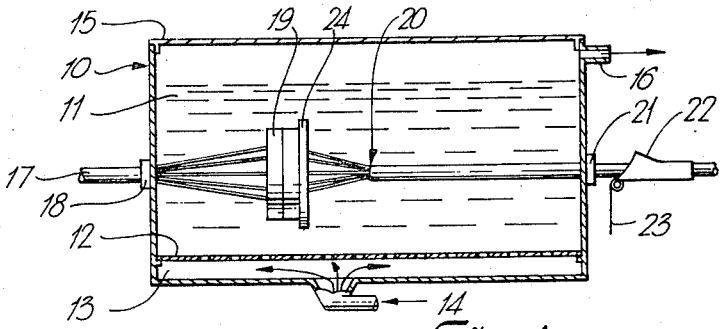
Fig-1
Fig-4
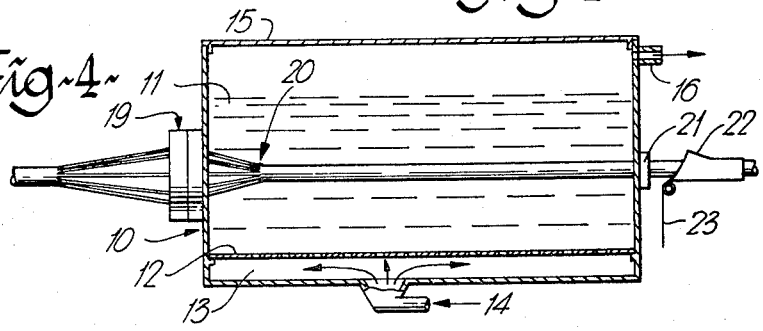
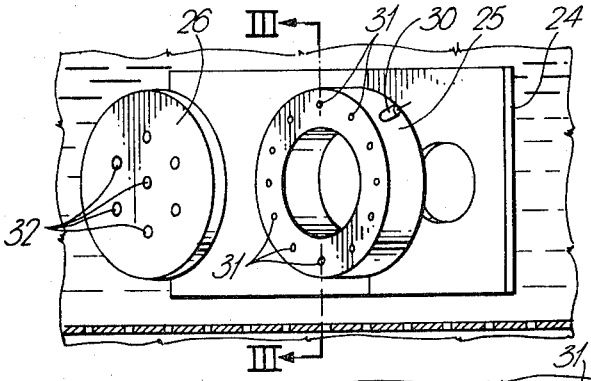
Fig-2
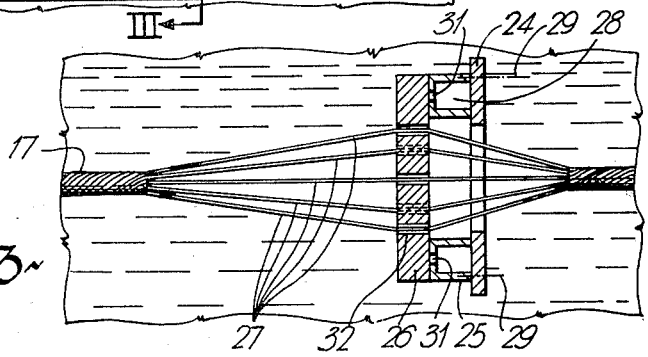
Fig-3

APPARATUS FOR USE IN FLUIDIZED POWDER FILLING OF MULTIPLE CORE UNIT CABLES

This application is a continuation-in-part of application Ser. No. 930,236, filed Aug. 2, 1978 now U.S. Pat. No. 4,205,515.

This invention relates to apparatus for use in fluidized powder filling of multiple core unit cables, and is particularly concerned with opening means for opening a cable into the individual core units for filling.

In copending application Ser. No. 921,252 filed July 3, 1978, in the name of the present assignee there is described the fluidized powder filling of a cable core by passing the cable core through a fluidized bed in a substantially closed condition. There appears to be a limit to the size of cable core which can effectively be filled, and in the case of a telecommunications cable having a core composed of a multiplicity of pairs of conductors, a convenient maximum unit size is fifty pairs of conductors.

For cables having more than than this number of conductors, the cable core is "opened" to form a number of core units, each unit being in a substantially closed condition as it passes through the fluidized bed. The cable core can be opened before or after entering the fluidized bed, and closes back again in the bed.

In its broadest aspect, the invention is concerned with an opening device for opening a cable core into a plurality of core units, with the individual units being powder filled in a substantially closed condition. The opening device can be positioned in the fluidized bed or outside the bed prior to passage of the cable core through the bed. The device comprises an opening member freely riding on the cable core and supported against a support member through an air bearing arrangement.

The invention will be readily understood by the following description of certain embodiments, by way of example, in conjunction with the accompanying drawings, in which:

FIG. 1 is a diagrammatic longitudinal cross-section through a filling bed with an opening device in the bed;

FIG. 2 is a diagrammatic perspective view of the two basic parts of the device, shown spaced apart for clarity;

FIG. 3 is a cross-section on the line III—III of FIG. 2, with the device as in use;

FIG. 4 is a diagrammatic longitudinal cross-section through a filling bed with an opening device outside the bed, before entry of the cable core;

Figure 5:
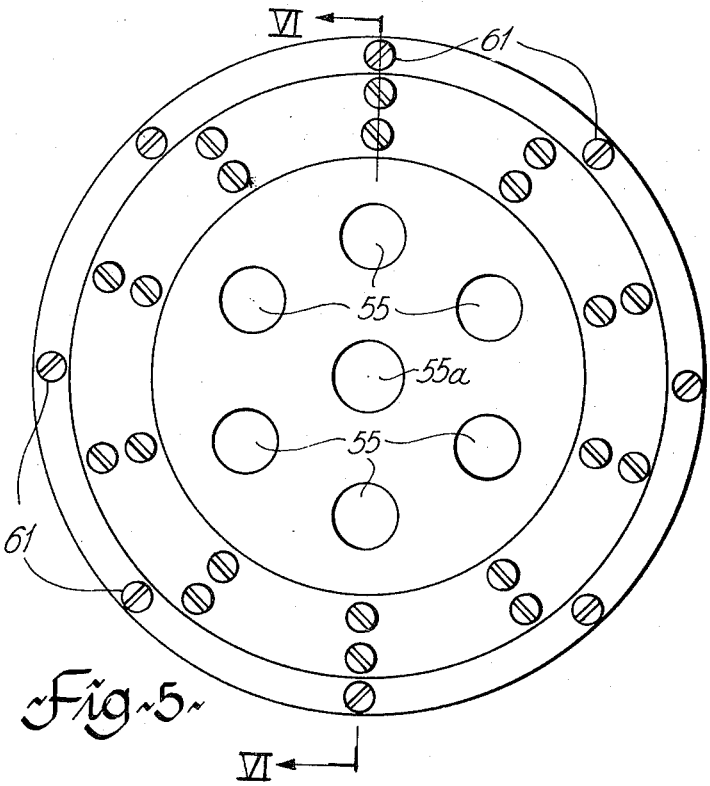
FIG. 5 is a front view of the opening device in FIG. 4, as it would be seen in the direction of the arrow A in FIG. 4.

As illustrated in FIG. 1, a fluidized powder filling bed is indicated generally at 10, the powder being in the main portion 11 having a perforated base member 12, an air box 13 under the member 12, with an air supply at 14. The main portion is covered by a lid 15 and dust extraction is provided at 16. The bed can be supplied with powder either by removing the lid or by providing an inlet. A typical form of bed is illustrated in the above mentioned application.

A cable core 17 enters via an inlet die 18 and then the core is opened by the core units passing through an opening device 19. After passage through the opening device the core units close together, as indicated at 20, and then exit through an exit die 21. After passing through the exit die the core can be wrapped, for example by a tape wrapping device 22 and tape 23. The opening device can be supported in the bed by a support plate 24 extending across the main portion 11.

The opening device 19 is illustrated in more detail in FIGS. 2 and 3. The device comprises a support member 25 attached to the support plate 24, and an opening member 26 which rides on the cable core 17, the core opens up into a plurality of core units 27. Support member 25 is annular in form and has an annular passage 28 formed from the back surface. The back surface of the support member is held tight against the support plate 24, as by screws at 29, and pressurized air is fed to the passage 28 via an inlet 30. Formed in the front face of the support member 25 are a number of small orifices 31 communicating with the passage 28. In operation, with the opening member 26 riding on the cable core, the drag on the opening member holds it against the support member 25, and the opening member is also maintained in alignment with the support member. High pressure air feeds through the orifices 31 and supports the opening member 26 a short distance away from the support member, allowing virtually friction free relative movement. The air also prevents fluidized powder penetrating between the two members. Holes 32 are formed through the opening member 26 for passage of core units therethrough.

To start the operation, the cable core is divided into the required number of core units after passage through the inlet die 18. While seven are shown in FIGS. 2 and 3, a smaller number can occur, or a large number. For large cable cores more than one row of holes 32 can be provided in the opening member. The individual core units are then put through the holes 32, then through the centre of the support member 25 and then out through the exit die 21. Usually a pulling member is attached to the end of the cable core to lead it through any successive stages and on to the take-up stool. The bed is then closed, air admitted to the air box 13 and the powder fluidized. The cable core is pulled through the bed, the core opening to pass through the opening member 26 and then closing again. The powder fills the interstices between the conductors in each core unit prior to the cable core closing together. There is some twist in the core units, about the longitudinal axis of the core, and the opening member 26 can rotate relative to the support member 25 quite easily.

FIG. 4 illustrates diagrammatically an alternative arrangement in which the opening device 19 is mounted on the outside of the bed 10 at the inlet to the filling portion 11. Where applicable the same reference numerals are used in FIG. 4, and in FIGS. 5 and 6, for the same items as in FIGS. 1 to 3. The cable core is opened into units before entering the fluidized bed, closing again in the bed at 20.

Figure 6:
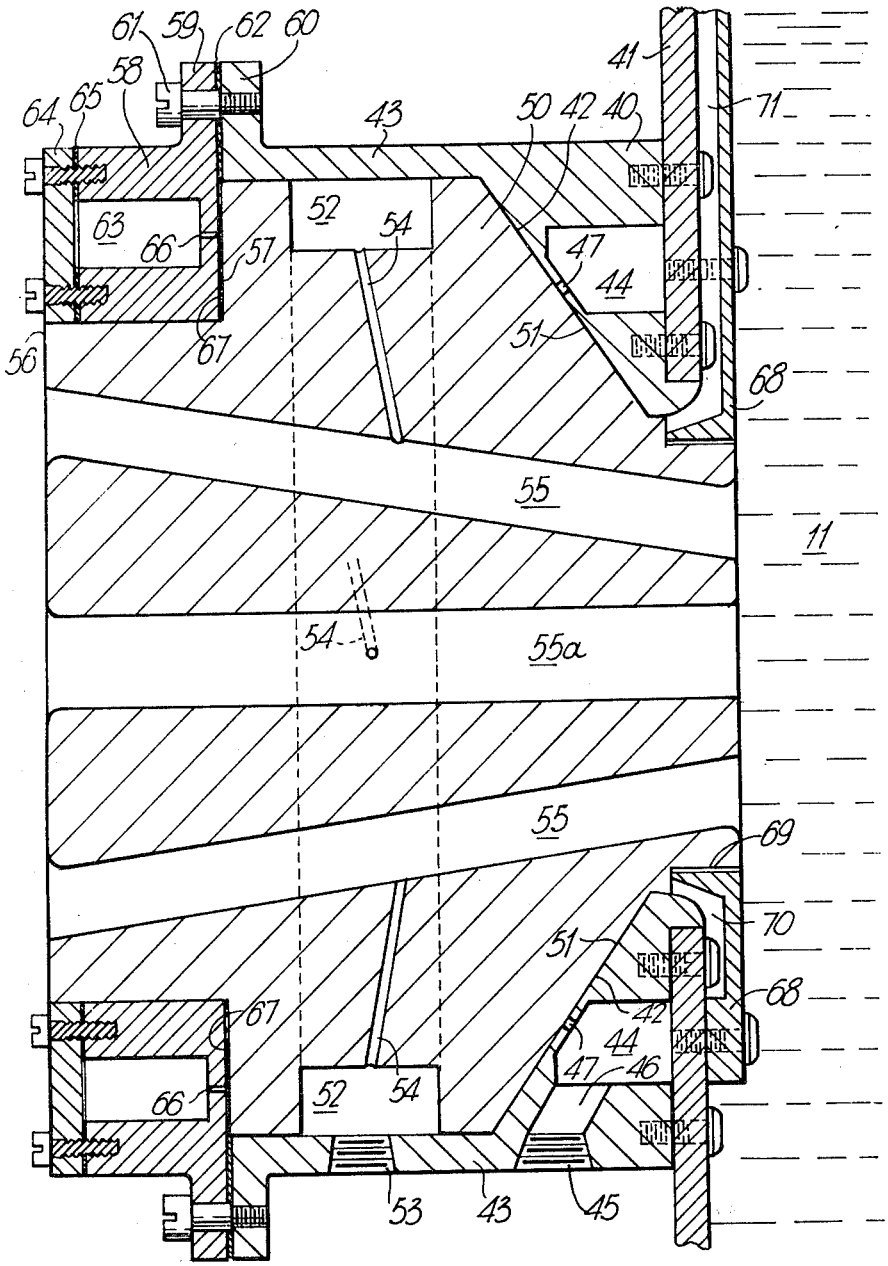
FIG. 6 is a cross-section on the line VI—VI of FIG. 5, illustrating the opening device in more detail.

FIGS. 5 and 6 illustrate in more detail the opening device 19 of FIG. 4. In this example a support member 40 is attached to the inlet end wall 41 of the main portion 11 of the bed. The support member 40 is tubular and has a conical support surface 42 and an annular wall 43 extending from the outer periphery of the conical surface forming a chamber. An annular channel 44 is formed in the back of the support member and pressurized air is supplied to this channel via an inlet 45 connecting passage 46. Small orifices 47 extend from the support surface 42 through to the channel 44.

Positioned within the support member 40 is an opening member 50. The opening member has a forward, conical surface 51 which is in opposition to surface 42. The periphery of the opening member is also a freely moveable fit inside the wall 43. An annular chamber 52 is formed in the periphery of the opening member and pressurized air is fed to this chamber via an inlet 53. From the chamber 52 air is fed via small diameter bores 54 to holes 55 and 55*a* extending through the opening member and through which pass the core units. The feature of the air supply bores 54 will be described later.

The rearward surface 56 of the opening member 50 is recessed around the periphery to provide a rearward bearing surface 57, and a retaining member 58 is positioned in the recess. The retaining member has a radially extending flange 59 which mates with a radially extending flange 60 on the support member 40 and screws 61 connect the two flanges together. A gasket 62 can be positioned between the flanges. The retaining member has an annular cavity 63, closed by a cover plate 64 with a gasket 65. Small orifices 66 connect the cavity 63 with the front surface 67 of the retaining member. Pressurized air is fed to the cavity 63 via an inlet, not shown.

In operation, once the cable core has been initially opened and the core units passed through the holes 55, and 55*a* through the bed 10, out through the unit die 21 and on the take up spool, air is supplied to the air box 13 to fluidize the powder and also to the channel 44, chamber 52 and cavity 63.

The pressurized air fed to the channel 44 and cavity 63 flows through the orifices 47 and 66 and forms an air bearing between the support member and the opening member. There is thus virtually no friction between support member and opening member. Air will also flow between the outer periphery of the opening member and the inner surface of the wall 43.

Figure 7:
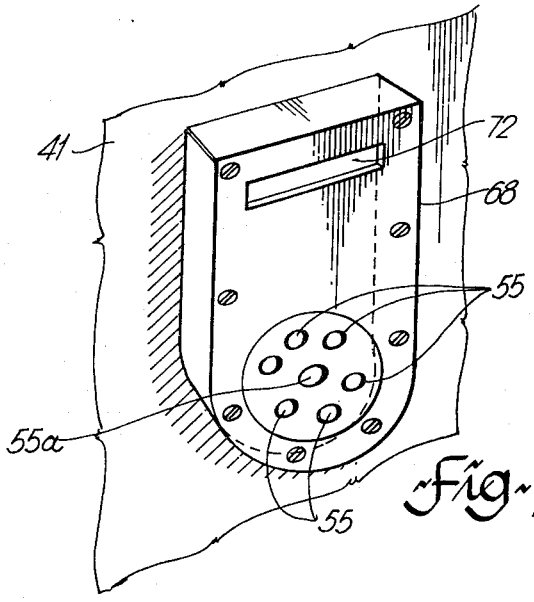
FIG. 7 is a perspective view on the inner face of the inlet wall of the bed, showing an air collector.

Although the core units are passing through the holes 55 and 55*a* at a fairly high speed, say over 100 ft. per minute, powder tends to escape from the bed out through the holes. By feeding air in via inlet 53, chamber 52 and bores 54, a small net flow of air into the bed can be achieved, preventing outflow of powder. The flow of this air can be controlled so that powder leakage is just prevented. The air flowing from the orifice 47 between conical surfaces 42 and 51 flows out from between these surfaces at the mounting position on the end wall 41. This flow could interfere with the fluidized bed and a collection system can be provided. As seen in FIGS. 6 and 7, collector member 68 is attached to the inside of the wall 41, the inner periphery of the member 68 situated in a recess 69 in the forward end of the opening member. The inner portion of the member 68 is recessed on the side facing the support member 40 and opening member 50 and forms an annular conduit 70 into which the air flows from between surfaces 42 and 51. The annular conduit 70 connects via a passage 71 to an outlet 72 opening into the space above the bed at 11. The bed exhaust is slightly below atmosphere pressure.

Similarly, an air supply can be provided to feed air to the holes 32 in the opening member of FIGS. 1, 2 and 3.

Thus the opening member 50 rides freely on the cable core and can rotate freely within the support member as the cable core passes through the bed. The number of holes 55 can vary depending upon core size and number of core units. More than one row of holes 55 can be provided, as necessary. It is also possible to provide an opening member with a large number of holes 55, with means for blocking those holes not used.

Figure 8:
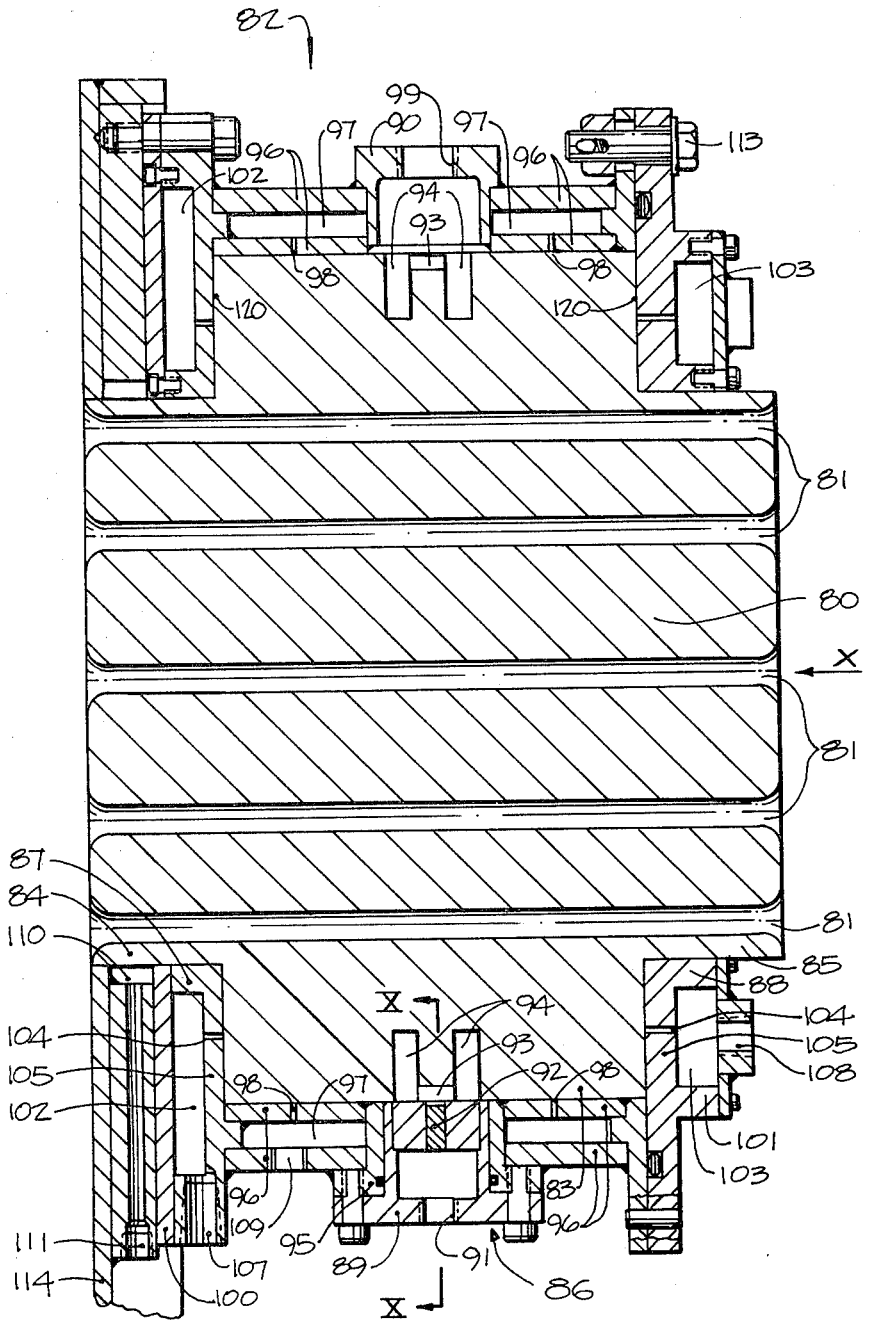
FIG. 8 is a cross-section through an alternative form of cable opening device, on the line VIII—VIII of FIG. 9.

The arrangement illustrated in FIG. 8 is for a large cable, the arrangement opening the cable into 18 units. The arrangement comprises an opening member or rotor 80 having eighteen axially extending holes 81 extending therethrough. The rotor is supported in a support member or housing, indicated generally at 82, and has a central portion 83 of larger diameter than end portions 84 and 85. The housing 82 has a central portion 86 and end portions 87 and 88, the inner bores of the portions 86, 87 and 88 being such that the rotor is a close rotating fit therein.

Inset into the central portion 86 of the housing 82 are a plurality of nozzle units 89 and a plurality of exhaust outlets 90. In the particular example illustrated there are four nozzle units 89 spaced 90° apart round the central portion 86, and four exhaust outlets 90 also spaced 90° apart and being midway between the nozzle units. Air is supplied to the nozzle units 89 via pipes, not shown, connected to threaded inlets 91, and exhaust air is exhausted through pipes, not shown, connected to threaded outlets 99. The four nozzle units 89 and four exhaust outlets 90 are shown in dotted outline in FIG. 9.

Figure 10:
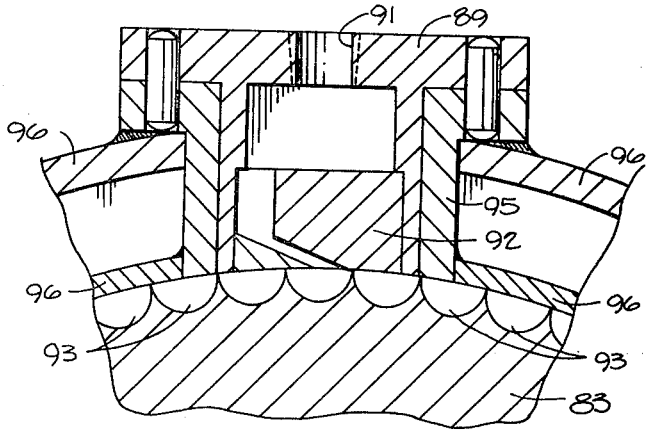
FIG. 10 is a partial cross-section, on the line X—X of FIG. 8, illustrating the structure at the periphery of the rotating member.

Positioned in each nozzle unit 89 is a nozzle member 92, illustrated in cross-section in FIG. 10. As shown, each nozzle member has an outlet end directionally inclined relative to a tangent to the surface of the central portion at the position of the nozzle member. The periphery of the central portion 83 of the rotor 80 has a plurality of semi-circular grooves 93 in alignment with the nozzle members 92. A circumferential groove 94 extends on either side of the grooves 93. The grooves 93, with the nozzle members 92, form an air turbine structure. Air admitted to a nozzle unit 89 is ejected by the nozzle member to impinge on the grooves 93 to produce a rotational effort on the rotor 80. The nozzle units 89 are mounted in circular housings 95 welded to the housing 82. The nozzle units can be inserted in the housings in one of two directions, either as illustrated in FIG. 10, or rotated through 180°. Thus the nozzle member can be positioned to eject air in one direction or another, 180° apart, and provides for both rotational and braking effort as required.

The central portion 86 of the housing on either side of the central section is formed by spaced members 96 to provide an annular air chamber 97. Small bores 98 extend through the inner members 96, and air passes through the bores 98 to form an air bearing between the periphery of the central portion of the rotor and the inner surfaces of inner members 96.

Similarly end members 100 and 101 form annular air chambers 102 and 103, with small bores 104 extending through the inner walls 105 of the chambers 102 and 103. Air flowing through the bores 104 forms air bearings between the end surfaces 120 of the central portion 83 of the rotor 80 and the end members 100 and 101.

Air, under pressure, is fed to chambers 102 and 103 via inlets 107 and 108 respectively and to chambers 97 via one or more inlets 109. Air escaping by flowing down between the end of the central portion 83 of the rotor and inner wall 105 of end member 100, at the left side of FIG. 8, can flow between the circumference of the reduced diameter portion 84 and the end member into chamber 110 and exhaust via outlet 111.

Depending upon the size of cable, and the number of units the cable needs to be divided into, so the rotor can have differing numbers of holes 81. For example rotors with 2 to 12 holes can be provided. Conveniently the dimensions of the rotor are standard, apart from the number, and possibly diameter, of the holes 81. Rotors can be replaced by removing the end portions 88 of the housing 82. The rotor 80 can then be slid out and another replaced. The end portion 88 is located and held in place by dowels 112 and cam action studs 113.

Figure 9:
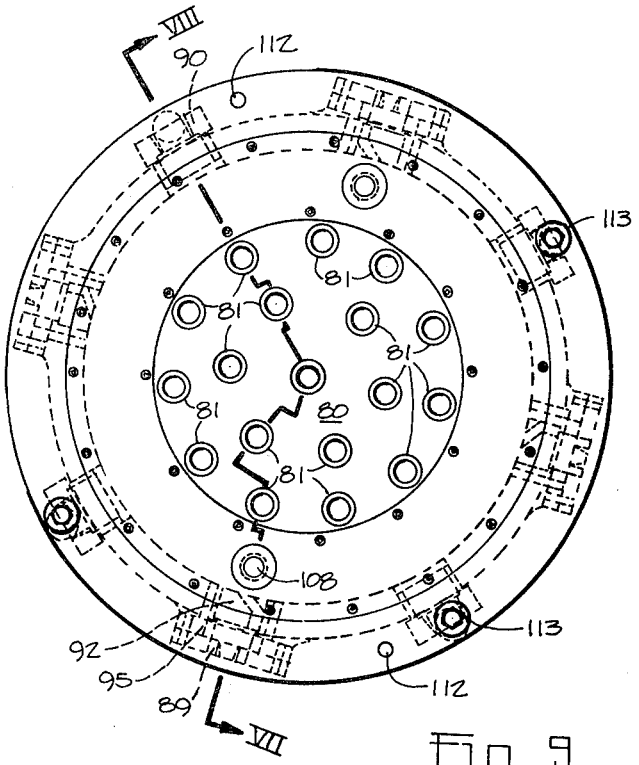
FIG. 9 is a face view in the direction of arrow A in FIG. 8, with certain hidden details shown in dotted outline.

In the example illustrated in FIGS. 8, 9 and 10, the cable moves through the rotor in a direction indicated by the arrow X in FIG. 8. The device is mounted on the end wall of the inlet end of the fluidized bed housing, the wall indicated at 114 in FIG. 8. Thus FIG. 8 is in the opposite sense to the arrangement illustrated in FIG. 6. While the twist of the cable units themselves will tend to rotate the rotor as the cable passes through the fluidized bed, with large cables the size of the rotor can be such as to create significant rotational drag. The use of the "turbine" effect of the nozzle members 92 and grooves 93 can be used to overcome this rotational drag. However, under some circumstances, the rotor can tend to rotate faster than is desired due to the rotation imposed on the rotor by the cable. In such circumstances, by reversing the nozzle members, as described above, a braking effort can be applied to the rotor. The "turbine" effect can be controlled by controlling the air supply to the nozzle units 89. The number of nozzle units used can be varied, and the number provided can also vary. The end loading imposed on the rotor, or opening member, 80 by passage of the cable is supported by the end member 100 which corresponds to the support member 25 in FIGS. 2 and 3 and support member 40 in FIG. 6. In the example illustrated in FIG. 8 the rotor or opening member 80 projects into a hole in the end wall 114. However, the arrangement of FIGS. 8, 9 and 10 can be mounted on a plate which in turn mounts on the end wall of the fluidized bed.

As a typical example, the bed 10 can be 4 ft. long. The cable core units close down at a position which can vary from about 6" to about18" from the inlet wall. The larger the cable the greater the distance the closing down from the inlet. The bed can be made shorter, but the size given will accommodate various cable sizes. It is believed that the length of bed beyond the closing down of the core units evens out the filling, but the majority of the filling occurs at the beginning before the core units close down. A typical air supply pressure is about 80 psi although this can vary and lower pressures have been used. The air flows are quite small. The size of the holes 32 and 55 will depend upon the size of the cable core units passing therethrough. As an example, for the arrangement as illustrated in FIGS. 5 and 6, the following table gives typical dimensions for a telecommunications cable, in which the cable core has been divided up so that core units of alternately twelve and thirteen pairs pass through holes 55, and a twenty-five pair unit passes through holes 55*a*. Other numbers of pairs per unit can be provided with corresponding adjustment to the hole diameters.

| Wire Gauge | Holes 55 | Hole 55a |
|---|---|---|
| 24 | .358" dia. | .468" dia. |
| 22 | .397" dia. | .515" dia. |
| 26 | .316" dia. | .406" dia. |
| 19 | .531" dia. | .703" dia. |

What is claimed is:

1. An opening device for opening a multiple core unit cable core into a plurality of core units comprising:

a support member comprising a tubular housing having a cylindrical central portion and cylindrical end portions on either side of said central portion;

an opening member comprising a rotor rotatably mounted in said housing and having a centre portion with end walls and end portions, one on each side of the centre portion, the centre and end portions of the rotor, respectively, being a close rotatable fit in said central portion and end portions of the housing, the rotor also defining a plurality of holes spaced apart around an axis of the rotor and extending axially there-through, each for passage of a core unit;

the rotor defining axially extending grooves around the periphery of its centre portion, the grooves opening outwardly onto and closed by the housing, at least one nozzle member in the central portion of the housing and directed inwardly onto the grooves, air supply means to said nozzle member to eject pressurized air from said nozzle member and onto said grooves to provide a rotational force on the rotor, and at least one exhaust for pressurized air, said exhaust opening onto said grooves and circumferentially spaced around the central portion of the housing from the nozzle member;

said end portions of said housing including surfaces in opposition to said end walls, and means to supply pressurized air between said end walls and said surfaces; and means to supply pressurized air between the periphery of the centre portion of the rotor and the central portion of the housing axially away from the at least one nozzle member to form at least one air bearing therebetween.

2. An opening device according to claim 1 wherein there are an even number of nozzle members, each nozzle member being diametrically opposed to another nozzle member across the rotor.

3. An opening device according to claim 1 wherein said axially extending grooves are of hemispherical cross-section, and the nozzle member has an outlet end directionally inclined relative to a tangent to the surface of the central portion at the position of the nozzle member.

4. Apparatus according to claim 3 wherein said device is mounted at an outer side of a wall at an inlet end of the structure with the support member attached to said wall, and a hole is defined through the wall, the hole being aligned with the plurality of holes in the opening member.

5. Apparatus for powder filling a multiple core unit cable core comprising a structure for containing a fluidizable bed of filling powder and for passage through the bed of a cable core, the structure carrying an opening device according to claim 1.

6. An opening device according to claim 1, said opening member including a central hole on the central axis of the opening member, and the plurality of holes lie disposed on at least one pitch circle around said central hole.

7. An opening device as claimed in claim 6, each of said holes in said at least one pitch circle being inclined inwardly towards said central axis from an inlet surface to an outlet surface on said opening member.

8. An opening device as claimed in claim 6, said central hole being larger than each hole on said at least one pitch circle.

9. An opening device as claimed in claim 6, said opening member including holes on a plurality of pitch circles around said central hole, the axis of all of said holes parallel to each other.

10. An opening device according to claim 1, including a plurality of nozzle members, each said nozzle member mounted in a nozzle unit, and including means for attaching said nozzle unit to said housing, and in the case of at least one of said nozzle units, said means for attaching said nozzle unit arranged to permit attachment of said nozzle unit in either of two positions, of 180° rotation apart.

* * * * *